US007683262B2

(12) United States Patent
Guery et al.

(10) Patent No.: US 7,683,262 B2
(45) Date of Patent: Mar. 23, 2010

(54) POWER TRANSMISSION CONDUCTOR FOR AN OVERHEAD LINE

(75) Inventors: Daniel Guery, Dour (BE); Michel Martin, Thuin (BE); Jacques Lobry, Mons (BE)

(73) Assignee: Nexans, Paris (FR)

( * ) Notice: Subject to any disclaimer, the term of this patent is extended or adjusted under 35 U.S.C. 154(b) by 141 days.

(21) Appl. No.: 11/986,791

(22) Filed: Nov. 26, 2007

(65) Prior Publication Data

US 2008/0128155 A1 Jun. 5, 2008

(30) Foreign Application Priority Data

Dec. 1, 2006 (FR) ..... 06 55250

(51) Int. Cl.
*H01B 7/18* (2006.01)

(52) U.S. Cl. ..... 174/102 R

(58) Field of Classification Search ..... 174/102 R, 174/102 A, 106 R, 108, 125.1, 126.1, 126.2, 174/128.1, 128.2
See application file for complete search history.

(56) References Cited

U.S. PATENT DOCUMENTS

2003/0194916 A1* 10/2003 Quesnel et al. ..... 439/784
2004/0026112 A1 2/2004 Goldsworthy et al. ..... 174/106
2004/0087733 A1* 5/2004 Nishihata et al. ..... 525/390
2004/0182597 A1* 9/2004 Smith et al. ..... 174/126.1
2005/0129942 A1* 6/2005 Hiel et al. ..... 428/375

FOREIGN PATENT DOCUMENTS

| | | |
|---|---|---|
| EP | 1 124 235 A2 * | 8/2001 |
| FR | 2836591 | 8/2003 |
| JP | 62127812 | 6/1987 |
| JP | 03129606 | 6/1991 |
| WO | 03091008 | 11/2003 |
| WO | 2005041358 | 5/2005 |

* cited by examiner

*Primary Examiner*—William H Mayo, III
(74) *Attorney, Agent, or Firm*—Sofer & Haroun, LLP

(57) ABSTRACT

A power transmission conductor, in particular for overhead electric lines, and including at least one central composite core made up of continuous fibers impregnated by a thermosetting resin matrix, the core being coated by at least one layer of insulating material, with aluminum or aluminum alloy conductor wires being wound around the core. The conductor comprises a short-circuiting device for short-circuiting said fibers with said conductor wires.

11 Claims, 2 Drawing Sheets

POWER TRANSMISSION CONDUCTOR FOR AN OVERHEAD LINE

RELATED APPLICATION

This application claims the benefit of priority from French Patent Application No. 06 55250, filed on Dec. 1, 2006, the entirety of which is incorporated by reference.

FIELD OF THE INVENTION

The invention relates to an electrical power transmission conductor for a high voltage overhead line.

More precisely, the invention relates to a conductor comprising at least one central composite core made up of continuous fibers impregnated with a thermosetting resin and having aluminum or aluminum alloy conductor wires placed thereabout.

BACKGROUND OF THE INVENTION

One such conductor is described in patent document JP 03-129606.

In that prior art document, the composite core is constituted by organic or inorganic fibers, e.g. of aramid, silicon carbide, or carbon, impregnated by a synthetic resin, preferably an epoxy resin. The core may be covered in a polyamide resin or taped in a polyimide film, so as to form an insulating layer. Aluminum conductor wires are wound around such a core or a set of such cores so as to form a power transmission conductor.

The polyimide covering serves in particular to prevent problems of corrosion at the interface between the conductor wires and the core including carbon fibers.

Given the non-zero resistivity of carbon fibers, some of the main current is diverted from the layers of aluminum or aluminum alloy conductor wires through the capacitor formed by the combination of said conductor wires, the insulating layer, and the carbon fibers. A potential difference thus appears across the terminals of the insulating layer. This potential difference gives rise to an electric field that is potentially unacceptable for the insulating layer, regardless of the nature of the thermosetting material of the matrix, regardless of the nature and the implementation of the insulating layer, and regardless of the number of layers of conductor wires.

By calculation, it can be shown that the voltage induced across said insulating layer is a function of the length of the conductor, and of the transmitted current, and is independent of the voltage between phases.

These conductors are for transmitting power at currents that may be equal to twice the corresponding current of an equivalent conventional cable, so the voltage induced across the insulating covering can cause damage thereto in the short or medium term.

To solve this problem, the invention provides a power transmission conductor, in particular for overhead electric lines, and including at least one central composite core made up of continuous fibers impregnated by a thermosetting resin matrix, the core being coated by at least one layer of insulating material, with aluminum or aluminum alloy conductor wires being wound around the core, the conductor including a short-circuiting device for short-circuiting said fibers with said conductor wires.

OBJECTS AND SUMMARY OF THE INVENTION

In a preferred embodiment, said device is disposed at least one end of the conductor.

And advantageously, said short-circuiting device is made when preparing anchoring sleeves and/or when preparing in-line joints.

The term "anchor sleeve" is used to mean the sleeve placed on a pylori and supporting one end of the conductor. The term "in-line joint" is used to mean a joint between conductor ends between two pylons.

Said insulating material may be a poly-ether-ether-ketone.

And preferably, said insulating material is poly(oxy-1,4-phenylene-oxy-1,4-phenylene-carbonyl-1,4-phenylene).

Said insulating material may be constituted by at least one tape placed on said core.

And preferably, the nature of said insulating material is glass fiber.

Said conductor wires may be wound to constitute at least one layer covering said core covered in said insulating material.

And preferably, the conductor includes a plurality of composite cores, at least one of which is covered in a said layer of insulating material.

The conductor may include a plurality of composite cores contained in a said layer of insulating material.

Said conductor wires placed in layers may be constituted by wires of round, trapezoidal, or Z shape. The shape of the conductor wires may vary as a function of the layer they are in.

Said fibers may be carbon fibers.

BRIEF DESCRIPTION OF THE DRAWINGS

The invention is described in detail below with the help of figures that merely show preferred embodiments of the invention.

MORE DETAILED DESCRIPTION

For conductors for overhead lines, there are three categories of temperature that need to be taken into consideration:

- the maximum temperature acceptable under continuous conditions;
- the maximum temperature acceptable during overloads of short, medium, or long durations; and
- the maximum temperature acceptable during a short circuit.

These conductors are such that, in all three of the above categories, the maximum temperature that is acceptable is greater than or equal to 200° C., which temperature is referred to below as the operating temperature.

Figure 1:
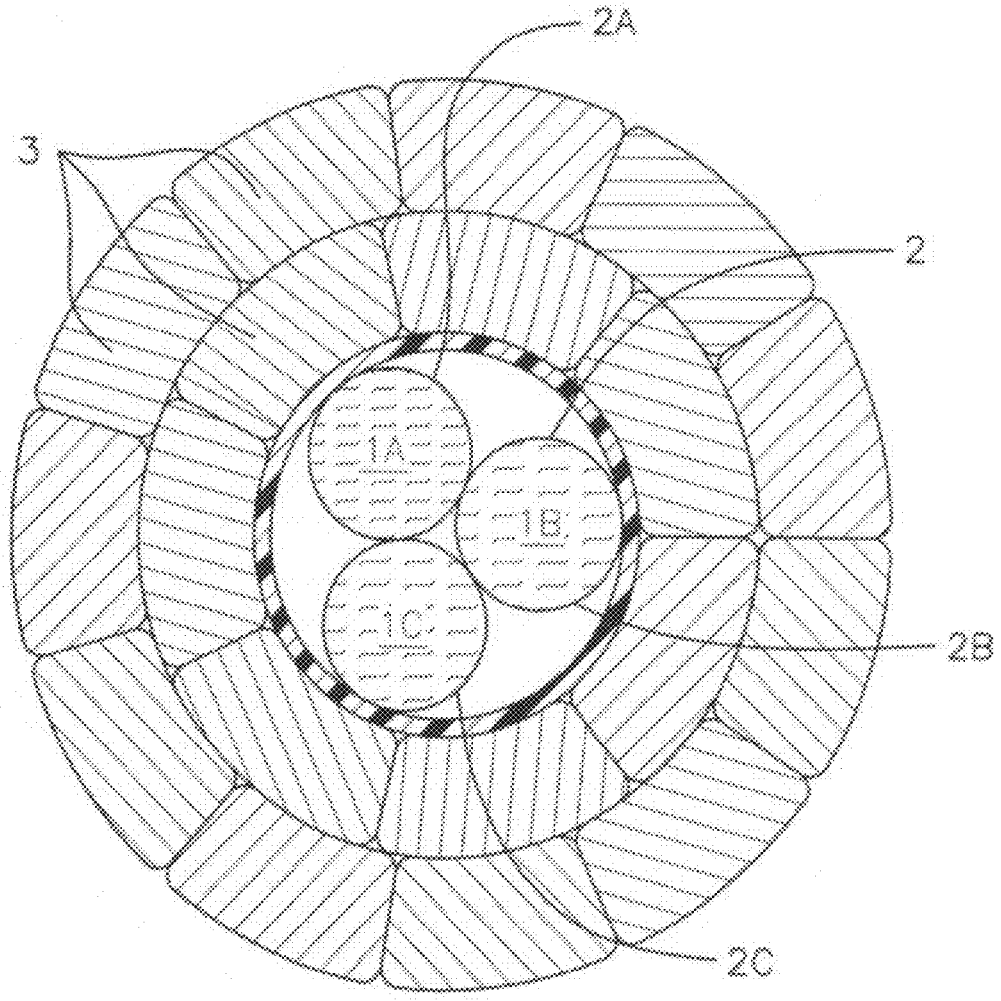
FIG. 1 is a cross-section view of a power transmission conductor in accordance with the invention.

FIG. 1 shows a power transmission conductor, in particular for overhead electricity lines, having an operating temperature that is greater than or equal to 200° C. It comprises at least one composite central core 1 made up of fibers, preferably continuous filaments of carbon fiber, impregnated by a thermosetting resin matrix, preferably an epoxy resin, the core being covered in a layer of insulating material 2 and by conductor wires made of aluminum or aluminum alloy 3 that are wound around the core.

Using a pultrusion method, the continuous fibers are impregnated with resin and then the resulting core is subjected to heat treatment by continuously raising its temperature.

Such a mechanical reinforcing core has the advantage of low specific weight and of accepting high levels of mechanical stress.

The core is constituted by a plurality of continuous carbon fiber filaments that are assembled together and impregnated with an epoxy resin, and it is such that:

- its ultimate tensile stress is greater than or equal to 2.6 gigapascals (GPa);
- its ultimate elongation is greater than 2%;
- its modulus of elasticity is greater than 90 GPa;
- its coefficient of linear expansion is less than $2\times10^{-6}$/° C.;
- its specific weight is less than 2 kilograms per cubic decimeter (kg/dm$^3$);
- its carbon fiber content by weight is greater than 70%;
- after aging for 30 days at the operating temperature of 200° C., its ultimate tensile stress is greater than or equal to 2.6 GPa in both of the following circumstances: core under a mechanical load of 25% of its initial mechanical stress, and core under no mechanical load; and
- after being wound through 180° on a maximum diameter of 120 times the diameter of the core and then subjected on three consecutive occasions to a mechanical load of 25% of its initial rupture load, the core presents an ultimate stress greater than or equal to 2.6 GPa.

The number of composite cores used for a conductor is such as to enable it to withstand an alternating bending test for demonstrating that the stresses present while stringing under mechanical tension through pulleys does not affect or degrade the performance of the conductor.

The conductor is tensioned to 15% of its nominal rupture load. A carriage is installed on the conductor, comprising three pulleys placed in a vertical plane and having their axes lying in a common horizontal plane, the spacing between the end pulleys is 3200 millimeters (mm)±600 mm.

The pulleys are of the same type as those used for stringing conventional conductors on overhead lines (grooved bottoms lined with neoprene):

| Bottom-of-groove pulley diameter (mm) | Conductor diameter (mm) |
|---|---|
| 800 | ≦38 |
| 1000 | >38 |

The carriage performs three go-and-return movements, at a horizontal speed lying in the range 0.5 meters per second (m/s) to 2 m/s over a length lying in the range 50 meters (m) to 60 m. Acceleration and braking is performed without jolting.

The conductor and accessory assembly must withstand at least 95% of the nominal rupture load of the conductor.

In the example shown, three cores 1A, 1B, and 1C are disposed centrally and are covered firstly in a layer of insulating material 2 and secondly each is covered in another layer of insulating material 2A, 2B, 2C. Aluminum or aluminum alloy conductor wires 3, in this case wires of trapezoidal shape, are wound in two layers on the cores.

According to the invention, the insulating material of the layers 2 is compatible with an operating temperature greater than or equal to 200° C. and it is put into place on the core 1 without subsequent heating.

In a first embodiment, the insulating material is extruded onto the core 1 and is constituted by a poly-ether-ether-ketone.

It is preferable to use the poly(oxy-1,4-phenylene-oxy-1,4-phenylene-carbonyl-1,4-phenylene) as sold under the name Victrex PEEK.

In a second embodiment, the insulating material is constituted by at least one tape of glass fibers.

In accordance with the invention, the conductor includes a device for short circuiting the carbon fibers and the aluminum or aluminum alloy conductor wires, which device is disposed at least one end of the conductor.

The short-circuiting device is implemented when preparing anchor sleeves or when preparing in-line joints.

Figure 2A:
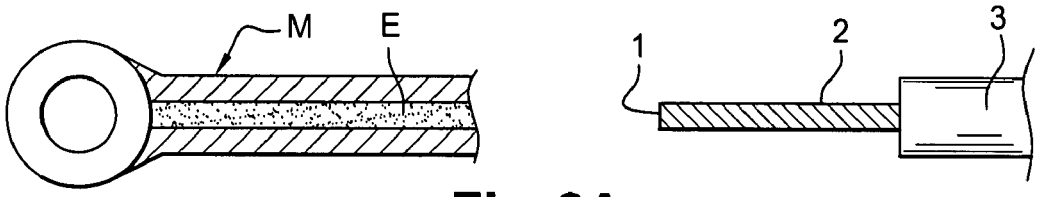
FIGS. 2A to 2C show a first embodiment of the invention.
Figure 2B:
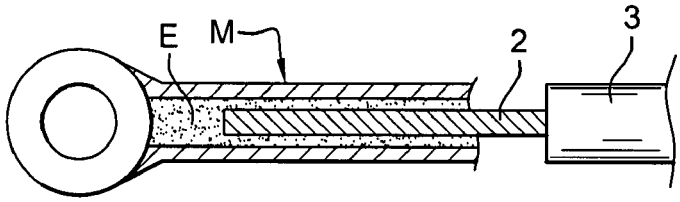
Figure 2C:
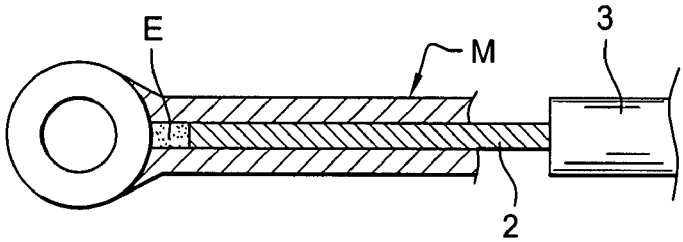

FIGS. 2A to 2C show a first embodiment of the invention.

FIG. 2A shows a conductor as described above in which the end of the core 1 or of the cores 1A, 1B, and 1C carrying their insulating layer has been stripped and freed of the conductor wires 3. This end of the conductor is for connection to a sleeve M containing an electrical contact protecting coating E. By compressing the metal jaw of the sleeve against the end of the core(s) 1 inserted therein, as shown in FIGS. 2B and 2C, the end is electrically connected with the metal jaw of the sleeve, which is in turn electrically connected to the aluminum or aluminum alloy conductor wires 3 of the conductor.

Figure 3A:
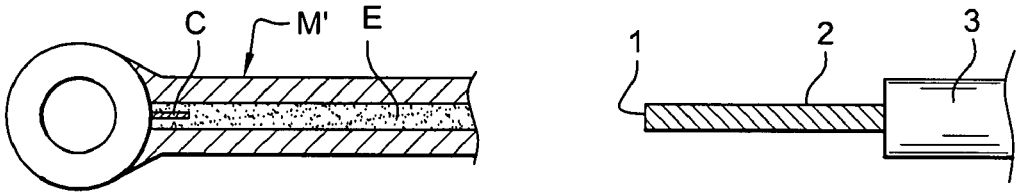
FIGS. 3A to 3C show a second embodiment of the invention.
Figure 3B:
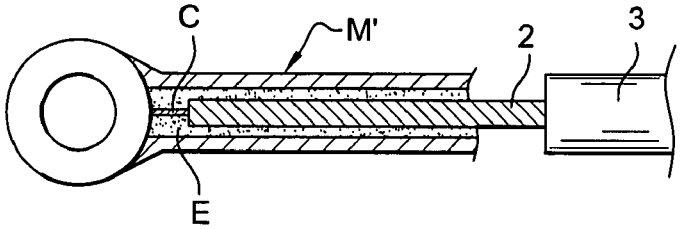
Figure 3C:
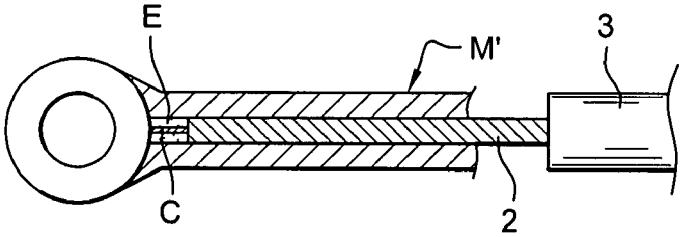

FIGS. 3A to 3C show a second embodiment of the invention.

FIG. 3A shows a conductor as described above with the end of its core 1 or cores 1A, 1B, and 1C provided with their insulating layer being stripped and free of conductor wires 3. This conductor end is for connection to a sleeve M' containing an electrical contact protecting coating E. The sleeve M' also includes a metal contact C. By inserting the core(s) 1 against the contact C, as shown in FIG. 3B, and then compressing the metal jaw of the sleeve against the end of the inserted core(s) 1, as shown in FIG. 3C, the end is put into electrical connection with the metal jaw of the sleeve, which is in turn electrically connected to the aluminum or aluminum alloy conductor wires 3 of the conductor.

What is claimed is:

1. A power transmission conductor, in particular for overhead electric lines, comprising:

at least one central composite core made up of continuous fibers impregnated by a thermosetting resin matrix, wherein the core is coated by at least one layer of insulating material, with aluminum or aluminum alloy conductor wires being wound around the core, the conductor including a short-circuiting device for short-circuiting said fibers with said conductor wires.

2. A conductor according to claim 1, wherein said device is disposed at least one end of the conductor.

3. A conductor according to claim 2, wherein said short-circuiting device is made when preparing anchoring sleeves and/or when preparing in-line joints.

4. A conductor according to claim 1, wherein said insulating material is a poly-ether-ether-ketone.

5. A conductor according to claim 4, wherein said insulating material is poly(oxy-1,4-phenylene-oxy-1,4-phenylene-carbonyl-1,4-phenylene).

6. A conductor according to claim 1, wherein said insulating material is constituted by at least one tape placed on said core.

7. A conductor according to claim 6, wherein the nature of said insulating material is glass fiber.

8. A conductor according to claim 1, wherein said conductor wires are wound to constitute at least one layer covering said core covered in said insulating material.

9. A conductor according to claim 8, including a plurality of composite cores, at least one of which is covered in a said layer of insulating material.

10. A conductor according to claim 8, including a plurality of composite cores contained in a said layer of insulating material.

11. A conductor according to claim 8, wherein said fibers are carbon fibers.

* * * * *